US007896478B2

(12) United States Patent
Kojima

(10) Patent No.: US 7,896,478 B2
(45) Date of Patent: Mar. 1, 2011

(54) FLUID PATH UNIT FOR FLUID EJECTION DEVICE

(75) Inventor: Masatomo Kojima, Ichinomiya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 436 days.

(21) Appl. No.: 12/074,019

(22) Filed: Feb. 28, 2008

(65) Prior Publication Data

US 2008/0204534 A1 Aug. 28, 2008

(30) Foreign Application Priority Data

Feb. 28, 2007 (JP) ..... 2007-049913

(51) Int. Cl.
*B41J 2/045* (2006.01)
*B41J 2/175* (2006.01)

(52) U.S. Cl. ..... 347/68; 347/85

(58) Field of Classification Search ..... 347/68, 347/70–72, 84, 85
See application file for complete search history.

(56) References Cited

U.S. PATENT DOCUMENTS 5,781,212 A 7/1998 Burr et al.
6,003,971 A 12/1999 Hanks et al.
6,955,418 B2 10/2005 Ito
2005/0151787 A1 7/2005 Brookfield et al.
2005/0190238 A1 9/2005 Hibi
2005/0231554 A1 10/2005 Sakaida et al.

FOREIGN PATENT DOCUMENTS

JP 2981826 9/1999
JP 2004-25636 1/2004
JP 2006-062260 3/2006
JP 2005-199710 7/2008

*Primary Examiner*—An H Do
(74) *Attorney, Agent, or Firm*—Frommer Lawrence & Haug LLP

(57) ABSTRACT

A fluid path unit for a fluid ejection device, includes: first pressure chambers arrayed in a first pressure chamber row; second pressure chambers arrayed in a second pressure chamber row adjacent to the first pressure chamber row; first outlet paths, through which the first pressure chambers respectively communicate with first nozzles, the first outlet paths arrayed in a first outlet path row; second outlet paths, through which the second pressure chambers respectively communicate with second nozzles, the second outlet paths arrayed in a second outlet path row; a common fluid reservoir; and first connection paths, though which the first pressure chambers communicate with the common fluid reservoir. Each of the first connection paths extends across the second outlet path row.

21 Claims, 9 Drawing Sheets

FLUID PATH UNIT FOR FLUID EJECTION DEVICE

CROSS REFERENCE TO RELATED APPLICATION

The present disclosure relates to the subject matter contained in Japanese patent application No. 2007-049913 filed on Feb. 28, 2007, which is expressly incorporated herein by reference in its entirety.

TECHNICAL FIELD

The present invention relates to a fluid ejection device, and in particular to a fluid path unit for the fluid ejection device.

BACKGROUND ART

JP-A-2004-25636 (U.S. Pat. No. 6,955,418) discloses an inkjet head as an example of a fluid ejection device for ejecting fluid from a nozzle. The inkjet head is designed to eject ink droplets from plural nozzles toward a recording sheet. The inkjet head has a fluid path unit and a piezoelectric actuator that is stacked on the fluid path unit. The fluid path unit has a common fluid reservoir connected to an ink supply port, and plural pressure chambers that corresponds to respective nozzles and that are disposed in fluid paths extending from the common fluid reservoir to the. The piezoelectric actuator selectively varies the volume of the pressure chambers to impart ejection pressure to ink in the pressure chambers, to thereby eject ink droplets from the nozzles.

When the actuator varies the volume of a pressure chamber, a pressure wave is caused in the pressure chamber, which includes not only an advancing component traveling toward the nozzle as the ejection pressure but also a receding component traveling toward the common fluid reservoir. If the receding component of the pressure wave propagates to another adjacent pressure chamber through the common fluid reservoir, so-called crosstalk problem arises. Therefore, the a damper wall for absorbing the receding component of the pressure wave is provided to face the common fluid reservoir.

Recent tendency of development in the field of a fluid ejection device is directed toward a higher density at which nozzles are arranged. In particular, in case of an inkjet head, the nozzles are desirably arranged at a higher density to make the head smaller in size and obtain an image at a higher resolution. Since there is a limit on the number of the nozzles arrayed into one row, nozzles for one color are likely to be arrayed into multiple rows. However, because the common fluid reservoir in the fluid path unit disclosed in JP-A-2004-25636 is elongated to overlap with a row of pressure chambers communicating therewith when viewed in a plan view, if the pressure chambers are arranged at a higher density and in multiple rows to accommodate the higher density and multiple row arrangement of the nozzles, the width of the common fluid reservoir is reduced. The reduced width of the common fluid reservoir undesirably deteriorates damping effect for the pressure wave occurring in the fluid stored in the common fluid reservoir.

SUMMARY

The present invention can provide, as an illustrative, non-limiting embodiment, a fluid path unit for a fluid ejection device, which includes: first pressure chambers arrayed in a first pressure chamber row; second pressure chambers arrayed in a second pressure chamber row adjacent to the first pressure chamber row; first outlet paths, through which the first pressure chambers respectively communicate with first nozzles, the first outlet paths arrayed in a first outlet path row; second outlet paths, through which the second pressure chambers respectively communicate with second nozzles, the second outlet paths arrayed in a second outlet path row; a common fluid reservoir; and first connection paths, though which the first pressure chambers communicate with the common fluid reservoir. Each of the first connection paths extends across the second outlet path row.

Accordingly, as one of advantages, the present invention can enhance the degree of freedom of layout of a common fluid reservoir. As another one of the advantages, the present invention can arrange nozzles at higher density. As yet another one of the advantages, the present invention can ensure a sufficiently long width of the common liquid chamber. As still another one of the advantages, the present invention can enhance damping performance of the common liquid chamber.

These and other advantages of the present invention will be described in detail with reference to the accompanying drawings.

DESCRIPTION OF THE PREFERRED EMBODIMENT

Illustrative, non-limiting Embodiments of the present invention will be described hereunder with reference to the drawings.

Figure 1:
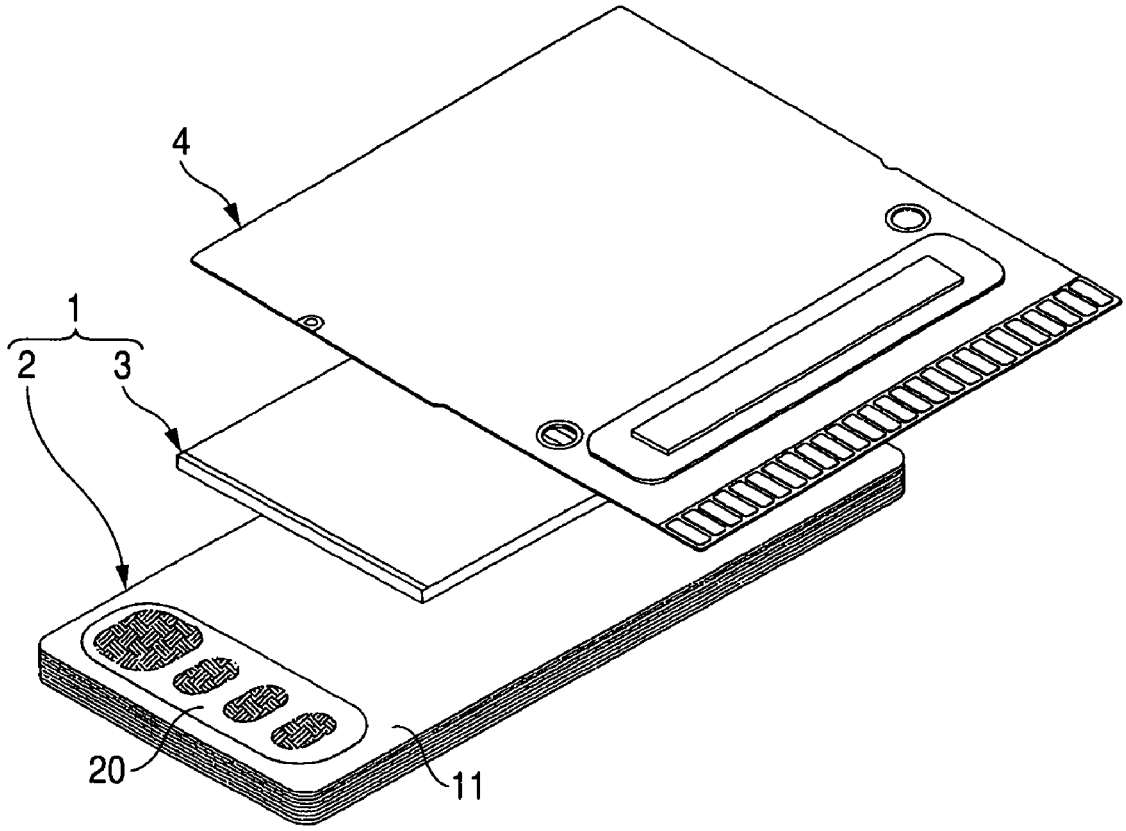
FIG. 1 is an exploded perspective view showing an inkjet head.

FIG. 1 is an exploded perspective view showing an inkjet head 1. As shown in FIG. 1, the inkjet head 1 has a fluid path unit 2 made up of plural plates stacked one on another, and a piezoelectric actuator 3 overlaid on and bonded to the fluid path unit 2. The fluid path unit 2 is configured so that ink is downwardly ejected from nozzles 25 (see FIG. 3) opened at a lower surface of the lowermost plate. A flexible flat cable 4 for establishing an electrical connection with an external device is superimposed on an upper surface of the piezoelectric actuator 3. Exposed terminals (not shown) on a lower surface of the flexible flat cable 4 are connected to surface electrodes (not shown) formed on the upper surface of the piezoelectric actuator 3. In relation to the concept of a direction used in the following descriptions, explanations are provided while a side of the fluid path unit 2 on which the piezoelectric actuator 3 is provided is taken as an upward direction and while a direction opposite to the side is taken as a downward direction.

Figure 2:
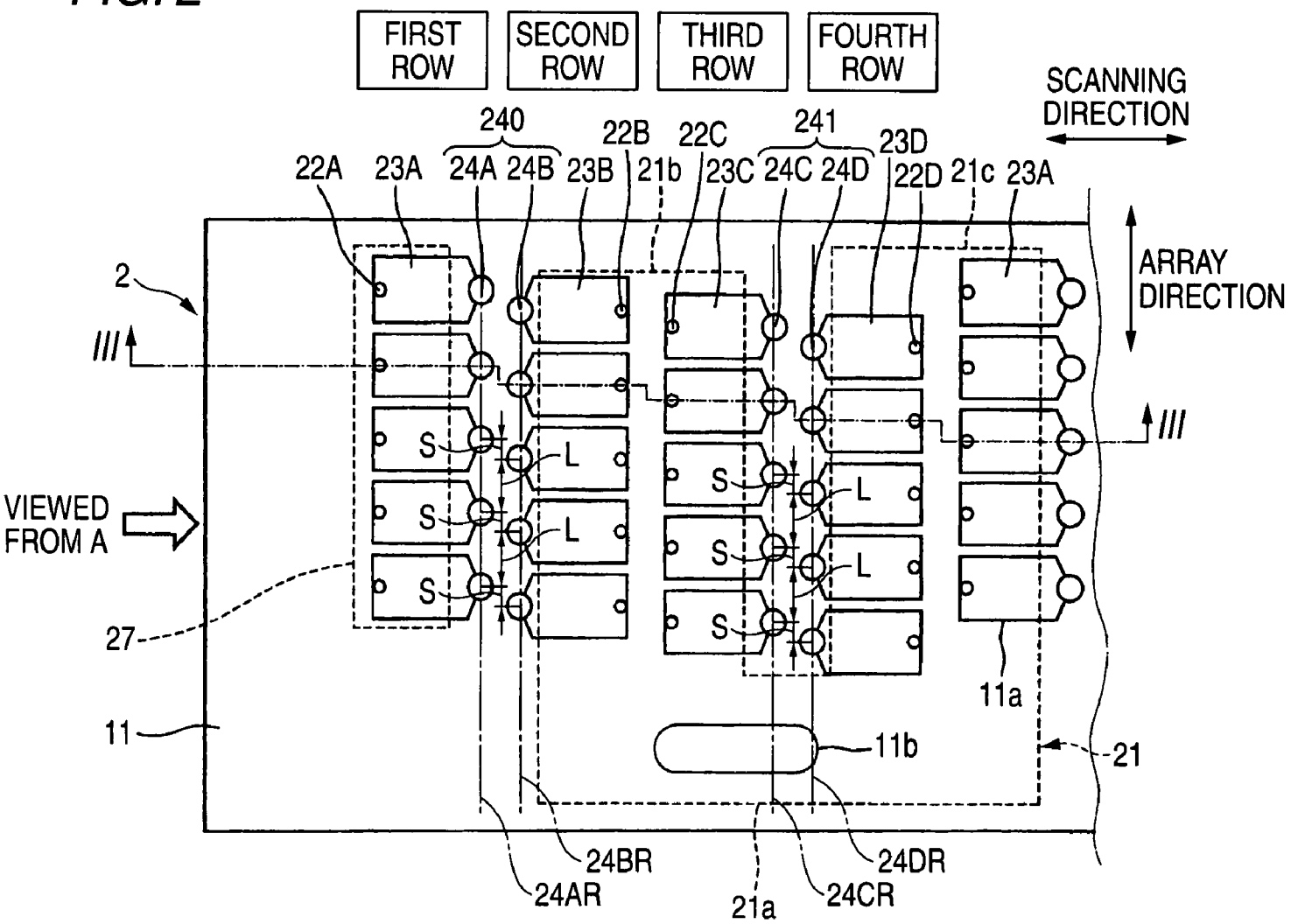
FIG. 2 is a plan view of a fluid path unit shown in FIG. 1.
Figure 3:
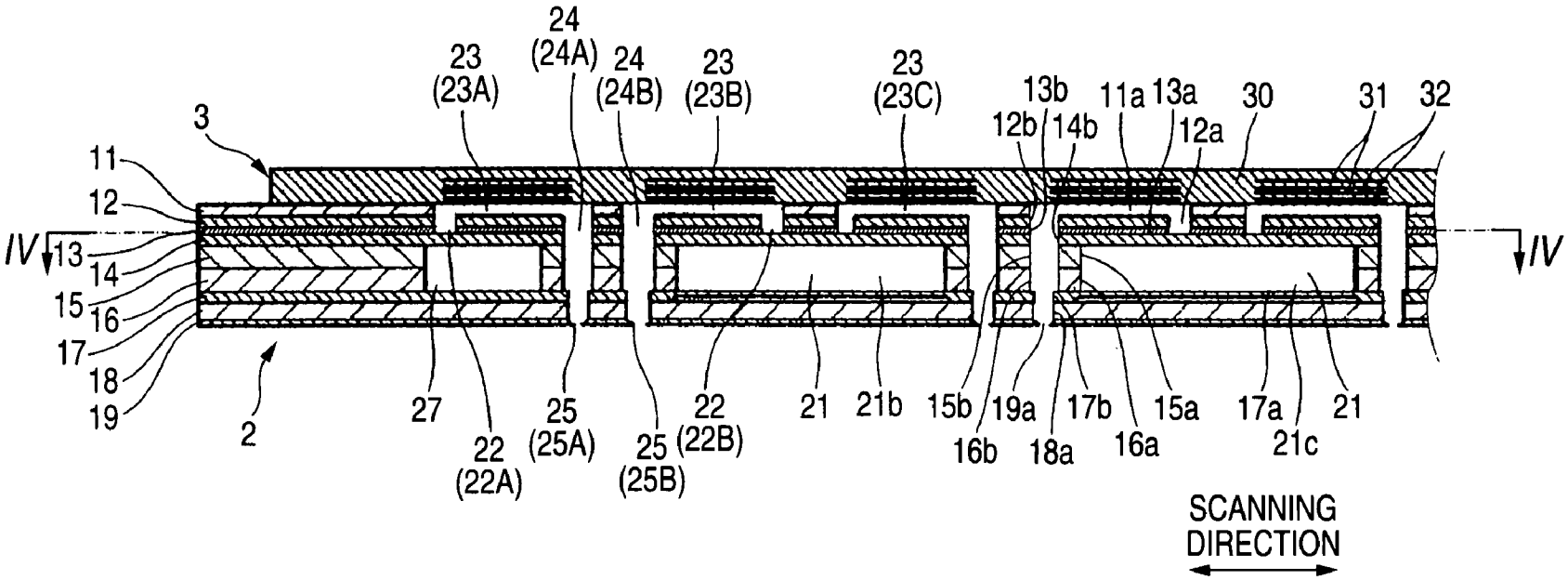
FIG. 3 is a cross-sectional view taken along line III-III shown in FIG. 2 to illustrate a piezoelectric actuator.

FIG. 2 is a plan view of the fluid path unit 2 shown in FIG. 1. FIG. 3 is a cross-sectional view taken along line III-III shown in FIG. 2, showing the piezoelectric actuator 3 (FIGS. 2 and 3 are enlarged partial views focusing on four left rows of pressure chambers 23 provided for black ink). As shown in FIG. 3, the piezoelectric actuator 3 includes plural piezoelectric sheets 30 stacked one on another, each of which is formed from a ceramics material of lead zirconate titanate (PZT) having a thickness of about 30 μm. The actuator 3 further includes discrete electrodes 31 and common electrodes 32 so that the piezoelectric sheet 30 is vertically interposed between the discrete electrodes 31 and the common electrodes 32. The discrete electrodes 31 are individually arranged to correspond to respective pressure chambers 23 to be described later, whilst the common electrodes 32 are continually arranged to correspond to the plural pressure chambers 23. The discrete electrodes 31 and the common electrodes 32 are electrically connected to the surface electrodes (not shown) on an upper surface of the top sheet, i.e. the highest layer, by way of side end faces or through holes of the piezoelectric sheets 30.

As shown in FIG. 3, the fluid path unit 2 includes a pressure chamber plate 11, a first spacer plate 12, a connection path plate 13, a second spacer plate 14, a first manifold plate 15, a second manifold plate 16, a damper plate 17, a cover plate 18, and a nozzle plate 19, which are arranged in this order from top and bonded together. The nozzle plate 19 is a resin plate such as polyimide, and the other plates 11 to 18 are a metal plate such as a 42% nickel alloy steel plate. Openings constituting fluid paths are formed in the plates 11 through 19 by means of electrolytic etching, laser machining, plasma jet machining, or the like.

First, the structure of the respective plates 11 through 19 is generally described. As shown in FIGS. 2 and 3, the pressure chamber plate 11 has pressure chamber holes 11*a*, which are arranged in four rows for each of four colors of ink. In FIGS. 2 and 3, four rows of the pressure chamber holes 11*a* for black ink and one of four rows of the pressure chamber holes 11*a* for yellow ink are shown, while illustration for other rows of the pressure chamber holes 11*a* for yellow, cyan and magenta ink is omitted. The pressure chamber plate 11 also has ink supply ports 11*b* as fluid inlet ports. In FIG. 3, one ink supply port 11*b* for black ink is shown, while illustration for other ink supply ports 11*b* for other colors is omitted. Hereafter, the discussion will be focused on a fluid path arrangement for black ink because each of fluid path arrangements for ink of other colors are substantively the same as the fluid path arrangement for black ink. As best shown in FIG. 3, each of the pressure chamber holes 11*a* is elongated in a direction orthogonal to an array direction when viewed in a plan view, and has a shape gradually tapered toward an outlet path 24 to be described later. The ink supply port 11*b* of the pressure chamber plate 11 is covered with a filter 20 (see FIG. 1) for eliminating dust that might be mixed in ink supplied from an ink tank (not shown).

Figure 4:
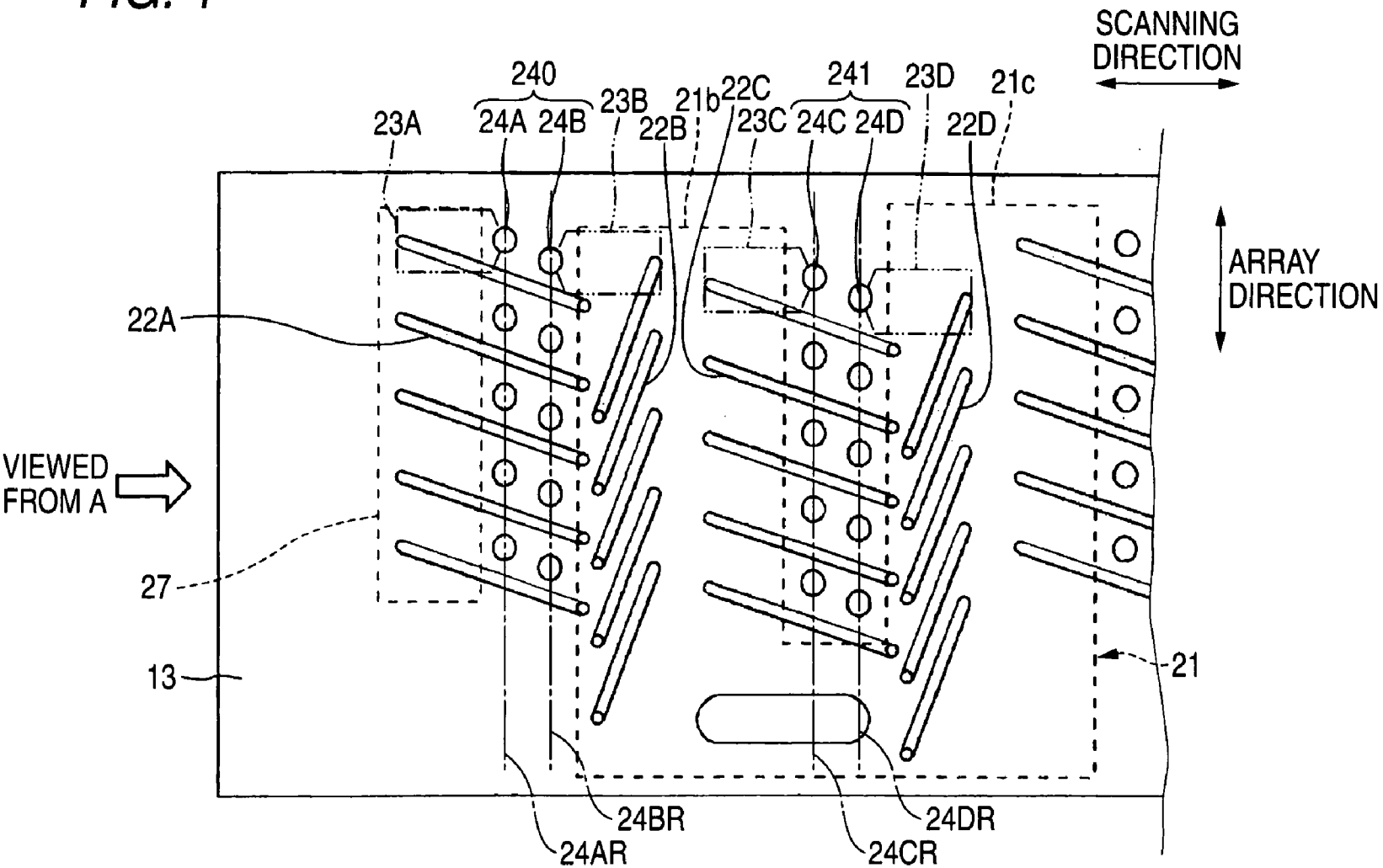
FIG. 4 is a cross-sectional view taken along line IV-IV shown in FIG. 3.
Figure 5:
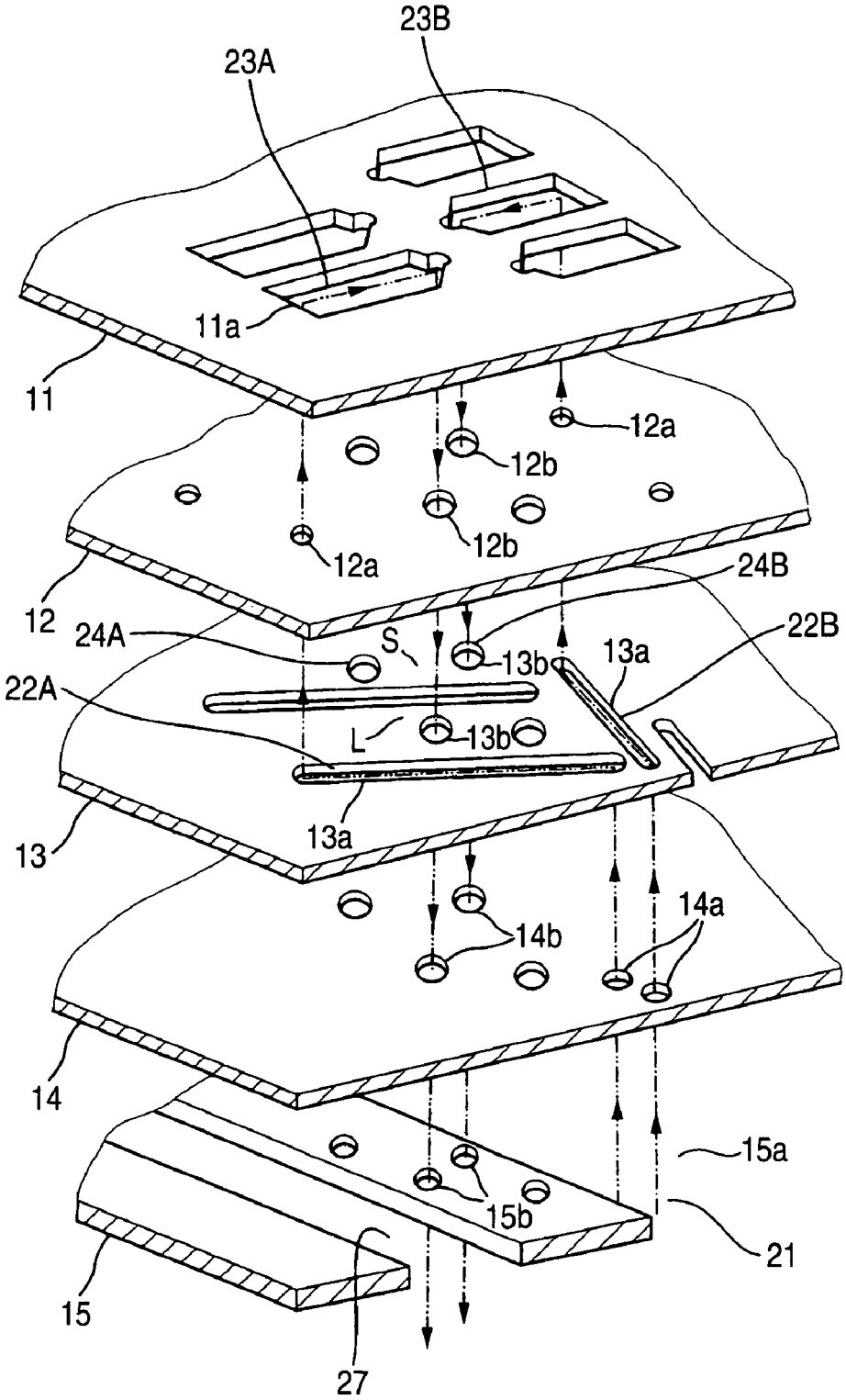
FIG. 5 is an exploded perspective view of a part of the fluid path unit shown in FIG. 1.

As shown in FIGS. 3 and 5, the first spacer plate 12 has: communication holes 12*a*, each in fluid communication with an end of a respective pressure chamber hole 11*a*; outlet through holes 12*b*, each in fluid communication with an opposite end of the respective pressure chamber hole 11*a*; and an ink supply hole (not shown) that has the same shape as that of the ink supply port 11*b* and that is in fluid communication with the ink supply port 11*b*. As best shown in FIG. 5, the connection path plate 13 has: elongated connection path holes 13*a* having one ends respectively in fluid communication with the communication holes 12*a*; outlet through holes 13*b* respectively in fluid communication with the outlet through holes 12*b*, and an ink supply port (not shown) that has the same shape as that of the ink supply port 11*b* and that is in fluid communication with the ink supply ports 11*b*. The second spacer plate 14 has communication holes 14*a* in fluid communication with the other ends of a respective connection path holes 13*a*; outlet through holes 14*b* in fluid communication with the respective outlet through holes 13*b*; and an ink supply hole (not shown) that has the same shape as that of the ink supply port 11*b* and that is in fluid communication with the ink supply port 11*b*. Connection paths 22 (22A, 22B, . . . as best shown in FIGS. 4 and 5), which will be described later, are defined by the first spacer plate 12, the connection path plate 13, and the second spacer plate 14.

As shown in FIG. 3, the first manifold plate 15 has: a first manifold hole 15*a* that is in fluid communication with the pressure chamber holes 11*a* of the corresponding rows (the four rows in this example) through the communication holes 12*a*, the connection path holes 13*a* and the communication holes 14*a* (see FIG. 5); and outlet through holes 15*b* in fluid communication with the respective outlet through holes 14*b*. The second manifold plate 16 has: a second manifold hole 16*a* that has the same shape as that of the first manifold hole 15*a* and that is in fluid communication with the first manifold hole 15*a*; and outlet through holes 16*b* in fluid communication with the respective outlet through holes 15*b*. A common fluid reservoir 21 (see FIG. 2), which is elongated in the array direction and which has a substantially U-shape, is mainly defined by the first and second manifold holes 15*a* and 16*a* of the first and second manifold plates 15 and 16.

As shown in FIG. 3, the damper plate 17 has: damper walls 17*a*; and outlet through holes 17*b* in fluid communication with the respective outlet through holes 16*b*. Each of the damper walls 17*a* is provided such that a recess is formed in the damper plate 17 to reduce the thickness of the wall portion of the damper plate and to be located in an opposite side of the first and second manifold holes 15*a* and 16*a*. The common fluid reservoir 21 partially defined by the damper wall 17*a*. A gap is formed between the damper wall 17*a* and the cover plate 18. The cover plate 18 has outlet through holes 18*a* in fluid communication with the respective outlet through holes 17*b*. The nozzle plate 19 has nozzle holes 19*a* that are in fluid communication with the respective outlet through holes 18*a*. Each of the nozzle holes 19*a* is reduced in diameter toward a downward end, and serves as the nozzle 25, from which ink can be ejected.

Fluid paths in the fluid path unit 2 will now be generally described. As shown in FIGS. 2 and 3, the first and second manifold holes 15*a* and 16*a* are vertically sandwiched between the second spacer plate 14 and the damper plate 17, thereby defining the common fluid reservoir 21. The common fluid reservoir 21 has the substantially U-shape as viewed in a plan view and extends in the array direction so as to overlap with the pressure chambers 23 to be described later. The common fluid reservoir 21 has a fluid introducing section 21*a* that is in fluid communication with the ink supply port 11*b*; a first common chamber 21*b* that extends in the array direction continuously from the left end of the fluid introducing section 21*a*; and a second common chamber 21*c* that extends in the array direction continuously from the right end of the base section 21*a*. A lower surface of the common fluid reservoir 21 is defined by the damper wall 17*a* that is substantially identical in shape and size to the common fluid reservoir 21. A lower side of a space situated along the side of the damper wall 17*a* opposite the common fluid reservoir 23 is closed by the cover plate 18. Although the first common chamber 21*b* and the second common chamber 21*c* are continuous to each other through the fluid introducing section 21*a* in this example, the first common chamber 21*b* and the second common chamber 21*c* can be separated from each other. In this case, two fluid paths are provided so that fluid can be supplied from the supply port 11*b* through the two fluid paths independently to the first common chamber 21*b* and the second common chamber 21*c*.

The common fluid reservoir 21 is in fluid communication with the plural pressure chambers 23 via the plural crank-shaped connection paths 22 (22A, 22B, see, for example, FIGS. 4 and 5). Each of the connection path 22 is formed by the communication hole 12*a* of the first spacer plate 12, the connection path hole 13*a* of the connection path plate 13 and the communication hole 14*a* of the second spacer plate 14. Fluid path resistance of the connection path 22 is greater than that of the outlet path 24 (24A, 24B, . . . , see, for example, FIG. 3) to be described later, thereby inhibiting backflow of fluid from the pressure chamber 23 to the connection path 22. To this end, the cross-sectional area of the connection path 22 is set smaller than the cross-sectional area of the outlet path 24 in this example.

The pressure chambers 23 are formed such that the pressure chamber holes 11*a* are vertically sandwiched between the piezoelectric actuator 3 and the first spacer plate 12. The connection path 22 is in fluid communication with one end of a respective pressure chamber 23, and the outlet path 24 is in fluid communication with the other end of the respective pressure chamber 23. Each of the outlet paths 24 is formed by the outlet through holes 12*b*, 13*b*, 14*b*, 15*b*, 16*b*, 17*b*, and 18*a* (see FIGS. 5 and 3). The outlet path 24 extends vertically such that the axis of the outlet path is parallel to a stacking direction of the plates (a direction orthogonal to the plate surface). The outlet path is in fluid communication with the nozzle 25.

The layout of the connection paths 22 will now be described in detail by reference to FIGS. 2 through 5. FIG. 4 is a cross-sectional view taken along line IV-IV shown in FIG. 3. FIG. 5 is an exploded perspective view of the part of the fluid path unit 2 shown in FIG. 1. The pressure chambers 23A to 23D arranged in the first to fourth rows from the left in FIG. 2 are for use with black ink. The pressure chambers 23A arrayed in the first row and the pressure chambers 23B arrayed in the second row are in fluid communication with the first chamber 21*b* of the common fluid reservoir 21 through the connection paths 22A and 22B (see FIG. 4). The pressure chambers 23C arrayed in the third row and the pressure chambers 23D arrayed in the fourth row are in fluid communication with the second chamber 21*c* of the common fluid reservoir 21 through the connection paths 22C and 22D (see FIG. 4).

As shown in FIG. 2, the pressure chambers 23A of the first row are disposed at positions spaced leftwardly away from the common fluid reservoir 21 as viewed in a plan view (as viewed in a direction in which the pressure chambers are deformable). The pressure chambers 23B of the second row are arranged at positions where the pressure chambers 23B overlap with the first chamber 21*b* of the common fluid reservoir 21 as viewed in the plan view (as viewed in the direction in which the pressure chambers are deformable). The pressure chambers 23A of the first row and the pressure chambers 23B of the second row are arranged in such a manner that sides of the pressure chambers 23A to be brought in fluid communication with the outlet paths 24A and sides of the pressure chambers 23B to be brought into fluid communication with the outlet paths 24B are made close to each other; and that sides of the pressure chambers 23A to be brought in fluid communication with the connection paths 22A and sides of the pressure chambers 23B to be brought into fluid communication with the connection paths 22B are spaced apart from each other.

Two rows 24AR and 24BR of the outlet paths 24A and 24B are interposed between the first row of the pressure chambers 23A and the common fluid reservoir 21 as viewed in a plan view. Given that an aggregation of the outlet paths 24A and 24B of the two rows is taken as an outlet path group 240, axes of outlet paths of the outlet path group 240 are arranged at uneven intervals in the array direction when viewed from a direction A (FIG. 2) orthogonal to both the array direction of the outlet paths 24A and 24B and the direction of the axes of the respective outlet paths. Specifically, the outlet path group 240 has large spacing sections L where the distance between the axes of the adjacent outlet paths 24A and 24B is large and small spacing sections S where the distance between the axes of the adjacent outlet paths 24B and 24A is small. The large spacing sections L and the small spacing sections S are alternately arranged with respect to the array direction.

As shown in FIGS. 4 and 5, the connection paths 22A in fluid communication with the pressure chambers 23A of the first row serve as cross-paths 22A (the connection paths 22A are hereinafter referred to also as the cross-paths 22A). That is, the connection paths 22A extends across the rows 24AR and 24BR of the outlet paths 24A and 24B to connect the first chamber 21*b* of the common fluid reservoir 21 to the pressure chambers 23A of the first row. Further, the cross-paths 22A pass through the large spacing sections L of the outlet path group 240, and are arranged obliquely with respect to the array direction when viewed in a plan view. A dummy space 27 is provided below the pressure chambers 23A of the first row. The dummy space 27 is provided by forming dummy holes in the first and second manifold plates 15 and 16 (see FIG. 3), and the dummy space 27 is substantially identical with the common fluid reservoir 21 in terms of a height in the vertical direction and a length in the array direction.

The connection paths 22B in fluid communication with the pressure chambers 23B of the second row serve as noncross-paths 22B (the connection paths 22B are hereinafter referred to also as the noncross-paths 22B). That is, the connection paths 22B does not extend across the rows 24AR and 24BR of the outlet paths 24A and 24B to connect the first chamber 21*b* of the common fluid reservoir 21 to the pressure chambers 23B. As best shown in FIG. 4, the noncross-paths 22B are entirely located opposite from the pressure chambers 23A of the first row with respect to the row 24BR of the outlet paths 24B. The noncross-paths 22B and the cross-paths 22A have substantially the same fluid path cross-sectional area and fluid path length to provide substantially the same fluid path resistance. Consequently, the nozzles 25A (see FIG. 3) in fluid communication with the cross-paths 22A and the nozzles 25B (see FIG. 3) in fluid communication with the noncross-paths 22B can exhibit a similar ejection characteristic. In order to make the noncross-path 22B substantially identical in length to the cross-path 22A, the inclination of the noncross-path 22B is greater than that of the cross-paths 22A with respect to the scanning direction when viewed in a plan view.

The first chamber 21*b* of the common fluid reservoir 21 is sufficiently wide in the scanning direction and long in the array direction to overlap with the pressure chambers 23B of the second row and the pressure chambers 23C of the third row when viewed in a plan view.

As shown in FIG. 2, the pressure chambers 23C of the third row are laid above the first chamber 21*b* of the common fluid reservoir 21 when viewed in a plan view. The pressure chambers 23D of the fourth row are disposed at positions where the pressure chambers 23D overlap with the second chamber 21*c* of the common fluid reservoir 21 when viewed in a plan view. The pressure chambers 23C of the third row and the pressure chambers 23D of the fourth row are arranged in such a manner that sides of the pressure chambers 23C to be brought in fluid communication with the outlet paths 24C (see FIG. 4) and sides of the pressure chambers 23D to be brought into fluid communication with the outlet paths 24D (see FIG. 4) are made close to each other; and that sides of the pressure chambers 23C to be brought in fluid communication with the connection paths 22C (see FIG. 4) and sides of the pressure chambers 23D to be brought into fluid communication with the connection paths 22D (see FIG. 4) are spaced apart from each other.

Two rows 24CR and 24DR of the outlet paths 24C and 24D are interposed between the pressure chambers 23C of the third row and the pressure chambers 23D of the fourth row when viewed in a plan view. The two rows 24CR and 24DR of the outlet paths 24C and 24D are interposed between the first chamber 21*b* and the second chamber 21*c* when viewed in a plan view. Given that an aggregation of the outlet paths 24C and 24D of the two rows is taken as an outlet path group 241, axes of outlet paths of the outlet path group 241 are arranged at uneven intervals in the array direction when viewed in the direction A (FIG. 2) orthogonal to the array direction of the outlet paths 24C and 24D and the direction of the axes of the outlet paths 24C and 24D. Specifically, the outlet path group 241 has large spacing sections L where the distance between the axes of the adjacent outlet paths 24C and 24D is large and small spacing sections S where the distance between the axes of the adjacent outlet paths 24C and 24D is small. The large spacing sections L and the small spacing sections S are alternately arranged with respect to the array direction.

As shown in FIGS. 4 and 5, the connection paths 22C in mutual communication with the pressure chambers 23C of the third row serve as cross-paths 22C (the connection paths 22C are hereinafter referred to also as the cross-paths 22C). That is, the connection paths 22C extend across the rows 24CR and 24DR of the outlet paths 24C and 24D to connect the second chamber 21*c* of the common fluid reservoir 21 to the pressure chambers 23C of the third row. Further, the cross-paths 22C pass through the large spacing sections L of the outlet path group 241, and are arranged obliquely with respect to the array direction when viewed in a plan view.

The connection paths 22D in fluid communication with the pressure chambers 23D of the fourth row serve as noncross-paths 22D (the connection paths 22D are hereinafter referred to also as the noncross-paths 22D). That is, the connection paths 22D do not extend across the rows 24CR and 24DR of the outlet paths 24C and 24D to connect the second chamber 21*c* of the common fluid reservoir 21 to the pressure chambers 23D. As best shown in FIG. 4, the noncross-paths 22D are entirely located opposite from the pressure chambers 23C of the third row with respect to the row 24DR of the outlet paths 24D. The noncross-paths 22D are made substantially identical to the cross-paths 22A, 22C and the noncross-paths 22B in terms of flow path cross-sectional area and flow path length, thereby exhibiting substantially the same fluid path resistance as that of the other paths 22A to 22C.

Figure 6:
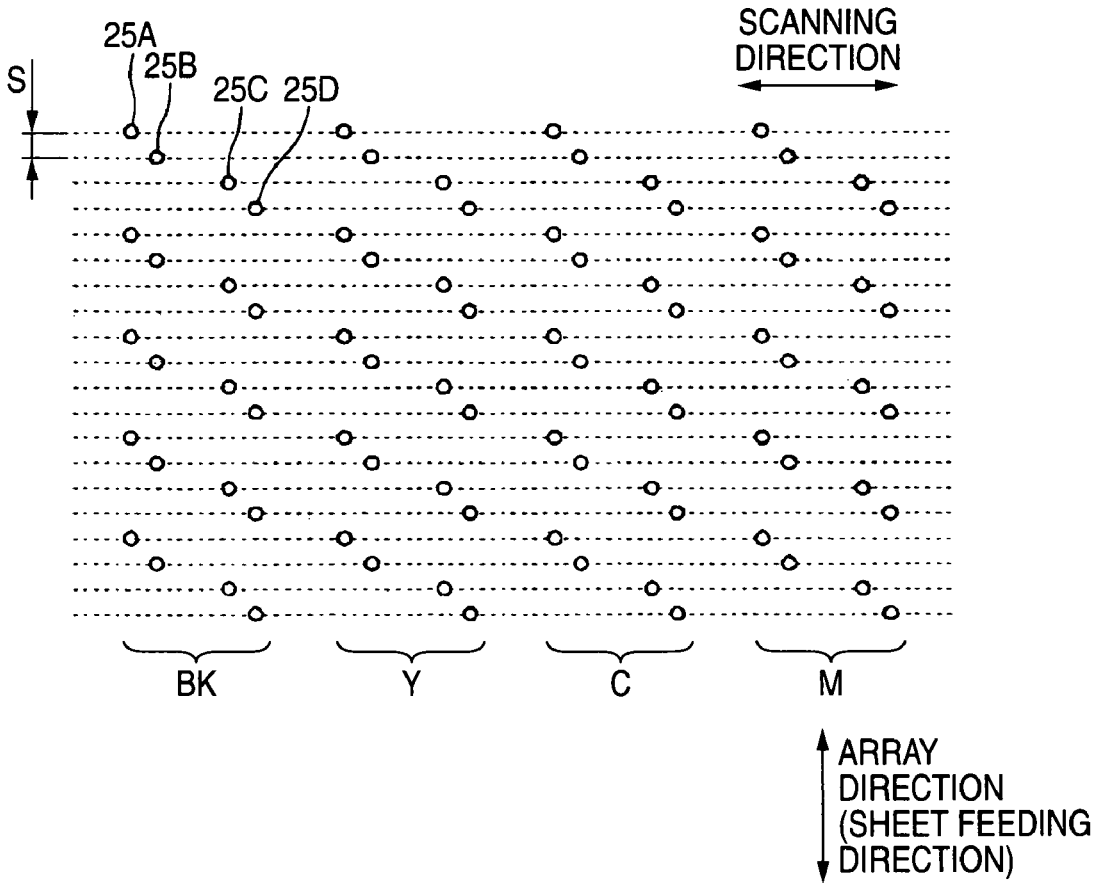
FIG. 6 is a drawing showing the layout of nozzles arranged on a nozzle surface of the fluid path unit shown in FIG. 1.

FIG. 6 shows the layout of nozzles arranged on a nozzle surface of the fluid path unit 2 shown in FIG. 1. As shown in FIG. 6, four rows of nozzles 25A to 25D are assigned to each of colors of black BK, yellow Y, cyan C, and magenta M. When attention is paid to the nozzles for one of the four colors, positions of the nozzles are offset sequentially from the first row to the fourth row at uniform intervals in the array direction (the sheet feeding direction), and the nozzles in the first row to the fourth row are arranged, as a whole, at the same pitch as that of the small spacing section S in the array direction. As a result, positions of the outlet paths 24A to 24D assigned to the nozzles 25A to 25D are also offset sequentially from the first row to the fourth row at uniform intervals in the array direction, and the outlet paths 24A to 24D in the first row to the fourth row are arranged, as a whole, at the same pitch as that of the small spacing sections S in the array direction. Two of the outlet paths 24A and 24B of the first and second rows and two of the outlet paths 24C and 24D of the third and fourth rows are alternately arranged in the array direction when viewed from direction of arrow A.

Next, operation of the inkjet head 1 will be described. As shown in FIG. 3, a voltage is selectively applied to the discrete electrodes 31 of the piezoelectric actuator 3, so that a potential difference arises between the discrete electrodes 31 and the common electrodes 32. An electric field acts on an active section of the piezoelectric sheets located between the electrodes 31 and 32, so that distortion deformation arises in the stacking direction. When pressure is imparted to ink in the pressure chamber 23 as a result of deformation of the active section, ink passes through the outlet path 24, and is ejected from the nozzle 25. A pressure wave acting on the pressure chambers 23 in this ejection process includes not only an advancing component traveling toward the nozzle 25 but also a receding component traveling toward the common fluid reservoir 21.

The receding component of the pressure wave is interrupted to a certain extent by means of the connection paths 22, but a portion of the receding component propagates to the common fluid reservoir 21. The receding component of the pressure wave having propagated to the common fluid reservoir 21 is absorbed by elasticity of ink in the common fluid reservoir 21 and elastic deformation of the thin damper wall 17*a*. Since each of the first and second chambers 21*b* and 21*c* of the common fluid reservoir 21 is sufficiently wide in the scanning direction, superior damping performance can be obtained. More specifically, acoustic capacity corresponding to a value expressing damping performance of the common fluid reservoir 21 is calculated from a sum of a term Cv, which is determined from the volume of the common fluid reservoir 21 and an elastic coefficient of ink, and a term Cd determined from elastic deformation of the damper wall 17*a*. However, since the term Cd is far greater than the term Cv, the acoustic capacity is evaluated primarily by the term Cd expressed by the following expression.

$$Cd = \frac{IdW_d^5(1 - v_d^2)}{60E_d t_d^3} \qquad \text{Mathematical Expression 1}$$

where Wd is the width (m) of the damper; td is the thickness (m) of the damper; ld is the length (m) of the damper; Ed is a modulus of elasticity (Pa) of the damper; and vd is a Poisson ratio of the damper.

The performance of damping the pressure wave obtained by the common fluid reservoir 21 becomes proportional to the fifth power of the width Wd of the damper. For this reason, since the common fluid reservoir 21 and the damper wall 17*a*, in particular, the common chamber 21*b*,21*c* and a corresponding portion of the damper wall 17*a* are widely formed so as to cover the two rows of pressure chambers 23, so-called crosstalk can be eliminated.

Each of the cross-paths 22A extends across the rows 24AR and 24BR of the outlet paths 24A and 24B. Hence, the pressure chambers 23A that do not overlap with the common fluid reservoir 21 can be connected to the wide first chamber 21*b* of the common fluid reservoir 21 through the cross-paths 22A. Similarly, each of the cross-paths 22C extends across the rows 24CR and 24DR of the outlet paths 24C and 24D. Hence, the pressure chambers 23C that do not overlap with the second chamber 21C can be connected to the wide second chamber 21*c* of the common fluid reservoir 21 through the cross-paths 22C. Accordingly, even when the fluid path unit 2 is miniaturized as a result of arrangement of the nozzles 25 at a high density, the pressure chambers 23A and 23C can be connected to the wide common fluid reservoir 21, and sufficient damping performance can be ensured.

Moreover, the cross-paths 22A pass through the large spacing sections L where a large distance exists between the axes of the adjacent outlet paths 24A and 24B, and the cross-paths 22C pass through the large spacing sections L where a large distance exists between the axes of the adjacent outlet paths 24C and 24D. Even when the nozzles 25 are made denser, it becomes possible to ensure a space where the cross-paths 22A and 22C are to be arranged. Further, the large spacing sections L and the small spacing sections S are alternately arranged in the array directions of the outlet paths 24A to 24D. The cross-paths 22A and 22C are arranged at uniform intervals in the array direction. Therefore, even when the nozzles are arranged at a higher density, the rigidity of the fluid path unit 2 can be maintained appropriately. Moreover, since the cross-paths 22A and 22C extend obliquely with respect to the array direction of the outlet paths 24A to 24D. Hence, the cross-paths 22A and 22C can pass through areas between the adjacent outlet paths 24A to 24D where the largest spacing is present. The rigidity of the fluid path unit 2 can be maintained more appropriately.

The pressure chambers 23B of the second row and the pressure chambers 23C of the third row are arranged to overlap with the first chamber 21*b* communicating with the pressure chambers 23A of the first row and the pressure chambers 23B of the second row. Hence, structural balance of the fluid path unit 2 becomes superior, and ejection characteristics can be made equal. Moreover, the dummy space 27 is formed at the position where the dummy space overlaps with the pressure chambers 23A of the first row. Hence, the rigidity of the pressure chambers 23A become equal to the rigidity of the other pressure chambers 23B to 23D that overlap with the common fluid reservoir 21. The ejection characteristics of the pressure chambers can be made equal more effectively.

Figure 7:
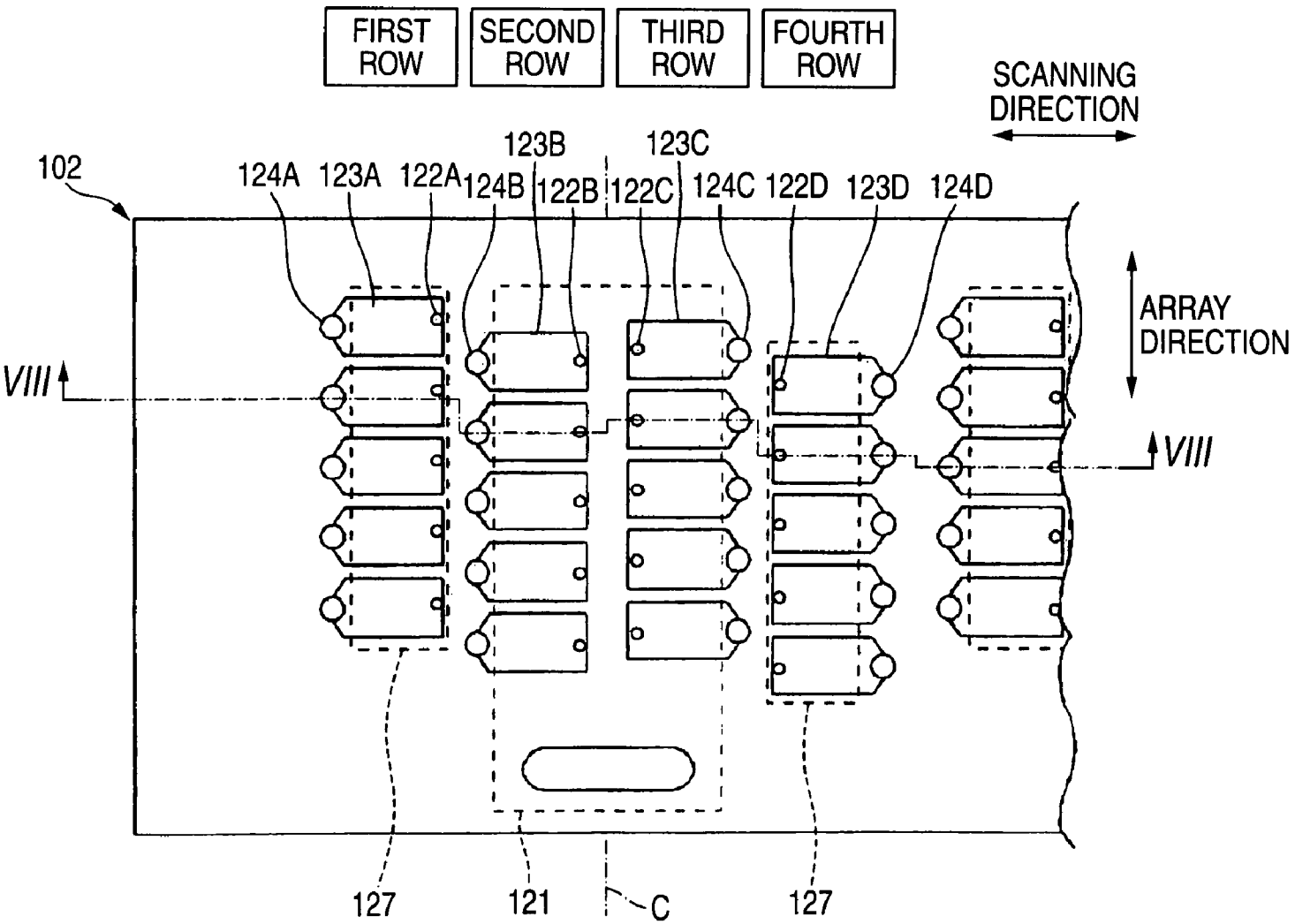
FIG. 7 is a plan view of another fluid path unit.
Figure 8:
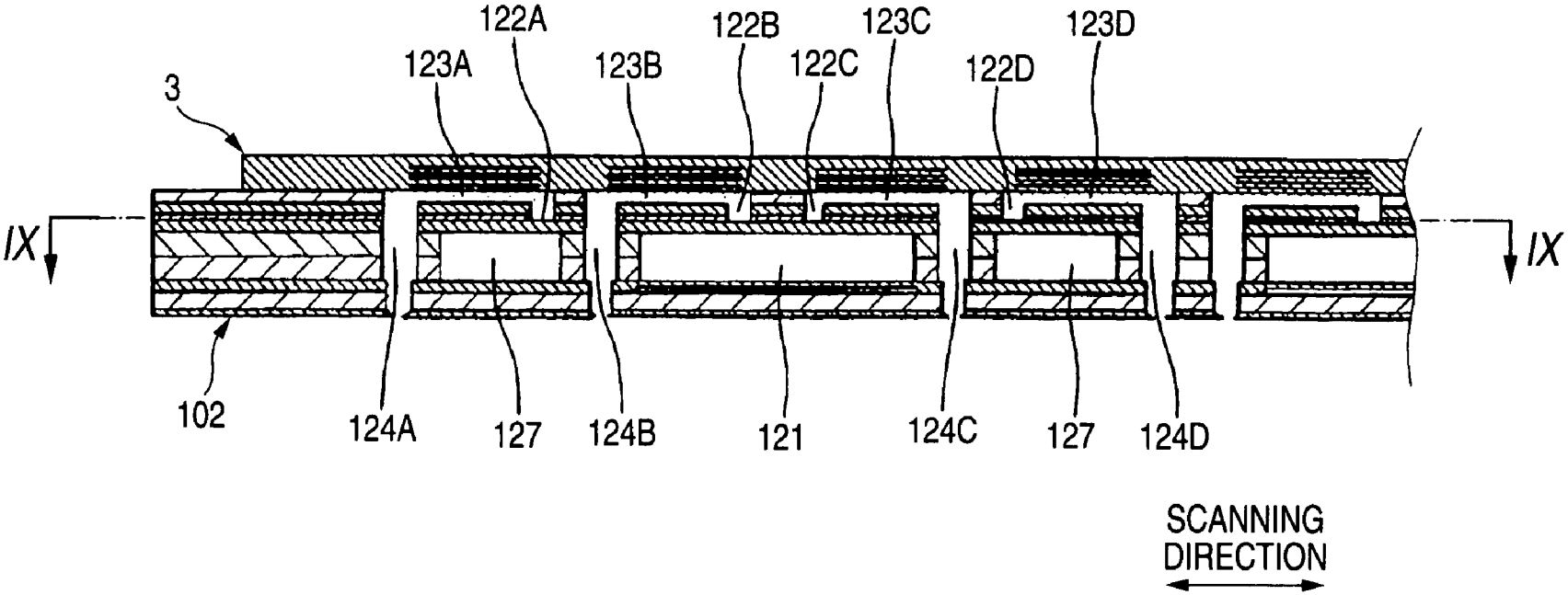
FIG. 8 is a cross-sectional view taken along line VIII-VIII shown in FIG. 7.
Figure 9:
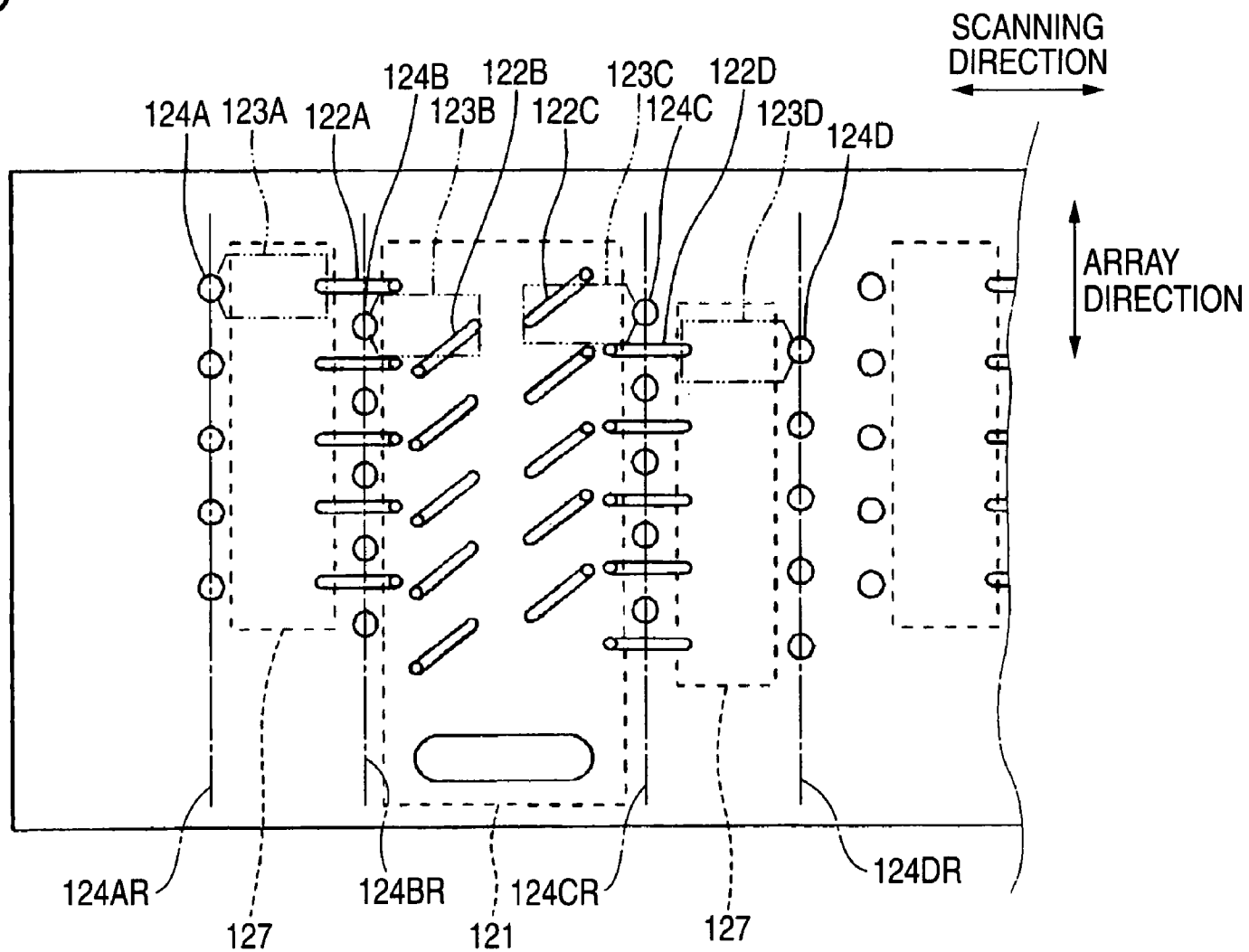
FIG. 9 is a cross-sectional view taken along line IX-IX shown in FIG. 8.

FIG. 7 is a plan view of a fluid path unit 102. FIG. 8 is a cross-sectional view taken along line VIII-VIII shown in FIG. 7. FIG. 9 is a cross-sectional view taken along line IX-IX shown in FIG. 8. The configuration of the fluid path unit 102 similar to that of the fluid path unit 2 is assigned the same reference numeral, and its explanation is omitted.

Pressure chambers 123A to 123D of the first to fourth rows from the left in FIG. 7 are for black ink use. Of these pressure chambers, the pressure chambers 123A and 123B of the first and second rows are in fluid communication with a common fluid reservoir 121 through connection paths 122A and 122B (see FIG. 9). The pressure chambers 123C and 123D of the third and fourth rows are in fluid communication with the common fluid reservoir 121 through connection paths 122C and 122D (see FIG. 9). Nozzles are arranged at uniform intervals, in a array direction when viewed in the direction of arrow A, in sequence of a nozzle assigned to the pressure chamber 123A of the first row, a nozzle assigned to the pressure chamber 123C of the third row, a nozzle assigned to the pressure chamber 123B of the second row, and a nozzle assigned to the pressure chamber 123D of the fourth row.

The pressure chambers 123A of the first row are disposed on the left spaced apart from the common fluid reservoir 121 when viewed in a plan view. The pressure chambers 123B of the second row are disposed at positions where the pressure chambers 123B overlap with the common fluid reservoir 121 when viewed in the plan view. The pressure chambers 123A of the first row and the pressure chambers 123B of the second row are arranged such that sides of the pressure chambers 123A that are in fluid communication with connection paths 122A and sides of the pressure chambers 123B that are in fluid communication with outlet paths 124B are in close proximity to each other. One row 124BR of the outlet paths 124B is arranged between the pressure chambers 123A of the first row and the common fluid reservoir 121 when viewed in the plan view.

As shown in FIG. 9, the connection paths 122A in fluid communication with the pressure chambers 123A of the first row serve as cross-paths 122A (the connection paths 122A are hereinafter referred to also as the cross-paths 122A). That is, the connection paths 122A extend across the row 124BR of the outlet paths 124B to connect the common fluid reservoir 121 to the pressure chambers 123A of the first row. The cross-paths 122A extend in a direction (the scanning direction) orthogonal to the array direction of the outlet paths 124. That is, the cross-paths 122A extend orthogonal to the array direction when viewed in the plan view. The array direction corresponds to the sheet feeding direction. Moreover, a dummy space 127 is provided below the pressure chambers 123A communicating with the cross-paths 122A.

The connection paths 122B in fluid communication with the pressure chambers 123B of the second row serve as noncross-paths 122B (the connection paths 122B are hereinafter referred to also as the noncross-paths 122B). That is, the connection paths 122B do not extend across the row 124BR of the outlet paths 124B to connect the common fluid reservoir 121 to the pressure chambers 123B. Each of the connection paths 122B is entirely located opposite from the pressure chamber 123A of the first row with respect to the row 124BR of the outlet paths 124B. The noncross-paths 122B are made substantially identical to the cross-paths 122A in terms of fluid path cross-sectional area and fluid path length to have substantially the same fluid path resistance as that of the cross-paths 122A. In order to make the noncross-paths 122B substantially identical in length to the cross-paths 122A, the noncross-paths 122B are tilted with respect to the scanning direction when viewed in the plan view.

The common fluid reservoir 121 is sufficiently wide in the scanning direction to overlap with the pressure chambers 123B of the second row and the pressure chambers 123C of the third row when viewed in the plan view. Pressure chambers 123C and 123D of the third and fourth rows are symmetrically arranged to the pressure chambers 123A and 123B of the first and second rows with respect to a center line C of the common fluid reservoir 121 when viewed in the plan view, and hence their detailed explanations are omitted.

The cross-paths 122A extend across the row 124BR of the outlet paths 124B. Hence, the pressure chambers 123A that do not overlap with the common fluid reservoir 121 can be connected to the wide common fluid reservoir 121 through the cross-fluid paths 122A. Similarly, the cross-paths 122D extend across the row 124CR of the outlet paths 124C. Hence, the pressure chambers 123D that do not overlap with the common fluid reservoir 121 can be connected to the wide common fluid reservoir 121 through the cross-paths 122D. Accordingly, even when the fluid path unit 102 is miniaturized and constructed at a higher density, the pressure chambers 123A and 123D can be connected to the wide common fluid reservoir 121 to ensure sufficient damping performance.

The cross-paths 122A in fluid communication with the pressure chambers 123A of the first row and the outlet paths 124B in fluid communication with the pressure chambers 123B of the second row are alternately arranged in the array direction. The cross-paths 122A can be shortened. Consequently, the path arrangement can be advantageously made simple, and thus manufacture can be made easy. Furthermore, the common fluid reservoir 121 is arranged to overlap with the pressure chambers 123B of the second row and the pressure chambers 123C of the third row. Hence, the sufficiently long width of the common fluid reservoir 121 can be ensured, and the path arrangement can be advantageously made simple, and thus manufacture can be made easy.

The present invention has been discussed with reference to a case in which the present invention is applied to the inkjet head. In stead, the present invention can be applied to other types of the fluid ejection device that can eject fluid other than ink, such as a device for ejecting coloring fluid to manufacture a color filter of a liquid-crystal display device and a device for ejecting electrically conductive fluid to form electrical wirings.

A piezoelectric actuator is used as pressure generation means for applying pressure to fluid in a pressure chamber. In stead, other types of pressure generation means, such as an actuator that can be displaced using static electricity, can be used.

The present invention can provide at least the following illustrative, non-limiting embodiments:

(1) A fluid ejection device including: a common fluid reservoir for storing fluid supplied from a fluid inlet port; plural connection paths through which the fluid from the common fluid reservoir flows while being divided; plural pressure chambers disposed in plural rows so as to come into fluid communication with the plural connection fluid paths respectively; pressure generation means for imparting ejection pressure to the fluid in the pressure chambers; and plural outlet path that correspond to the plural pressure chambers respectively and that guide the fluid in the pressure chambers to nozzles to eject the fluid from the nozzles, wherein pressure chambers of a first row among the pressure chambers of the plural rows are arranged, when viewed in a plan view, so as not to overlap with the common fluid reservoir that is in fluid communication with the pressure chambers of the first row, and at least one row of the outlet paths in fluid communication with pressure chambers of a second row adjacent to the pressure chambers of the first row is interposed between the first row of the pressure chambers and the common fluid reservoir; and connection paths in fluid communication with the pressure chambers of the first row are cross-paths that extend across the row of the outlet paths in fluid communication with the pressure chambers of the second row to connect the pressure chambers of the first row to the common fluid reservoir.

According to the device of (1), the cross-paths serving as connection paths in fluid communication with the pressure chambers of the first row are connected to the common fluid reservoir while extending across the row of the outlet paths in fluid communication with the pressure chambers of the second row. Hence, it is not necessary to provide the common fluid reservoir at a position where the common fluid reservoir overlaps with the pressure chambers of the first row when viewed in the plan view, and the degree of freedom of layout of the common fluid reservoir is significantly enhanced. When the degree of freedom of layout of the common fluid reservoir is enhanced as mentioned above, the sufficient width of the common fluid reservoir can be greatly ensured by effective utilization of the space even when the nozzles and corresponding pressure chambers are arranged at a higher density. Therefore, an attempt can be made to achieve higher integration of nozzles and enhanced damping performance of the common fluid reservoir.

(2) The device according to (1), wherein the pressure chambers of the second row overlap with the common fluid reservoir when viewed in the plan view, and the common fluid reservoir has such a width as to continuously overlap with the pressure chambers of at least the second row and a third row when viewed in the plan view.

According to the device of (1), since the common fluid reservoir has a great width so that the common fluid reservoir continuously overlaps with pressure chambers of at least two rows when viewed in the plan view, and hence damping performance of the common fluid reservoir is enhanced. Since the pressure chambers of the first row are connected to the common fluid reservoir through the cross-paths that extend across the outlet paths, a receding component, which travels toward the common fluid reservoir, of pressure waves acting on the pressure chambers of the first row can be effectively dampened.

(3) The device of (1) or (2), wherein connection paths that are in fluid communication with the pressure chambers of the second row are noncross-paths that do not extend across the row of the outlet paths; and the cross-paths and the noncross-paths have a substantially identical fluid path resistance.

According to the device of (3), even when cross-paths and noncross-paths are mixedly present as connection fluid paths in one fluid ejection device, nozzles in fluid communication with the cross-paths and nozzles in fluid communication with the noncross-paths can exhibit a substantially same ejection characteristic because the cross-paths and the noncross-paths are substantially identical to each other in terms of fluid path resistance.

(4) The device of (3), wherein the cross-paths and the noncross-path have a substantially identical fluid path cross-sectional area and a substantially identical fluid path length.

According to the device of (4), the fluid path resistance of the cross-paths and the fluid path resistance of the noncross-paths can be made substantially identical to each other by a simple configuration.

(5) The device of any one of (1) to (4), wherein the pressure chambers of the first row and the pressure chambers of the second row are arranged so that sides of the pressure chambers of the first and second rows in fluid communication with the outlet paths are in close proximity to each other and that sides of the pressure chambers of the first and second rows in fluid communication with the connection paths are separated from each other, and an aggregation of the outlet paths for both of the rows is taken as an outlet path group; axes of the outlet paths of the outlet path group are arranged at uneven intervals in a array direction when viewed in a direction orthogonal to both the array direction of the outlet paths and a direction of axes of the outlet paths; the outlet path group has large spacing sections where distance between axes of the adjacent outlet paths is large and small spacing sections where distance between axes of the adjacent outlet paths is small; and the cross-paths pass through the large spacing sections to extend across the outlet path group.

According to the device of (5), the cross-paths pass through the large spacing sections where the distance between axes of the adjacent outlet paths is large. Hence, even when nozzles are arranged at a higher density, space where the cross-paths are to be arranged can be ensured.

(6) The device of (5), wherein the large spacing sections and the small spacing sections are alternately arranged in the array direction of the outlet paths.

According to the device of (6), plural cross-paths can be arranged at uniform intervals in the array direction. Hence, even when rigid areas between fluid paths become narrow as a result of nozzle arrangement of higher density, structural balance of the ejection device becomes superior, and a drop in strength of the entire ejection device can be prevented.

(7) The device of (5) or (6), wherein the cross-paths pass through the large spacing sections of the outlet path group so as to be oblique with respect to the array direction of the outlet paths when viewed in the plan view.

According to the device of (7), the cross-paths obliquely extend across the rows of the outlet paths in fluid communication with the pressure chambers of both the first and second rows. Hence, the cross-paths can pass through areas where distance between adjacent outlet paths is great, and the strength can be enhanced to a much greater extent.

(8) The device of any one of (5) to (7), wherein plural sets, each having the pressure chambers of the first row and the pressure chambers of the second row, are arranged in a direction orthogonal to the array direction of the first and second rows, and the common fluid reservoir in fluid communication with the pressure chambers of the first and second rows of one set overlaps with the pressure chambers of the second row of the one set and the pressure chambers of the first row of another set when viewed in the plan view.

According to the device of (8), since the pressure chambers of adjacent sets overlap with the common fluid reservoir while being arranged side by side when viewed in the plan view, the width of the common fluid reservoir is greatly ensured. Moreover, the rigidities of the pressure chambers of these sets are made equal to each other, and therefore ejection characteristics can be made equal to each other.

(9) The device of any one of (1) to (4), wherein the pressure chambers of the first and second rows are arranged so that sides of the pressure chambers of the first row in fluid communication with the cross-paths and sides of the pressure chambers of the second row in fluid communication with the outlet paths are in close proximity to each other; and the cross-paths in fluid communication with the pressure chambers of the first row and the outlet paths in fluid communication with the pressure chambers of the second row are alternately arranged in the array direction.

According to the device of (8), wherein the cross-paths that bring the pressure chambers of the first row in fluid communication with the common fluid reservoir can be shortened. Hence, the configuration of fluid paths can be made simple and manufacture can be facilitated.

(10) The device of (9), wherein two sets, each having the pressure chambers of the first row and the pressure chambers of the second row, are arranged in parallel to each other so that sides of the pressure chambers of the first rows of the two sets, in fluid communication with the cross-paths, are made in close to each other; and the common fluid reservoir overlaps with the pressure chambers of both second rows of the two sets when viewed in the plan view.

According to the device of (10), since pressure chambers of four rows are in fluid communication with one common fluid reservoir, the width of the common fluid reservoirs can be greatly ensured. The configuration of fluid paths can be made simple, and manufacture can be facilitated.

(11) The device of any one of (1) to (10), further including a dummy space provided at a position where the dummy space overlaps with the pressure chambers in fluid communication with the cross-paths when viewed in the plan view.

According to the device of (11), since the dummy space is provided to overlap with the pressure chambers in fluid communication with the cross-paths when viewed in the plan view. Hence, the pressure chambers overlapping with the dummy space and the pressure chambers overlapping with the common fluid reservoir are made equal to each other in terms of rigidity, so that ejection characteristics of the pressure chambers can be made equal to each other.

(12) The device of any one of (1) to (11), further including an elastically deformable damper wall facing the common fluid reservoir.

According to the device of (12), the pressure waves propagating to the fluid in the common fluid reservoir can be absorbed by elastic deformation of the damper wall, and therefore crosstalk can be effectively eliminated.

What is claimed is:

1. A fluid path unit for a fluid ejection device, comprising:

first pressure chambers arrayed in a first pressure chamber row;

second pressure chambers arrayed in a second pressure chamber row adjacent to the first pressure chamber row;

first outlet paths, through which the first pressure chambers respectively communicate with first nozzles, the first outlet paths arrayed in a first outlet path row;

second outlet paths, through which the second pressure chambers respectively communicate with second nozzles, the second outlet paths arrayed in a second outlet path row;

a common fluid reservoir;

first connection paths, though which the first pressure chambers communicate with the common fluid reservoir; and second connection paths, through which the second pressure chambers communicate with the common fluid reservoir, wherein the second pressure chambers overlap with the common fluid reservoir as viewed in a direction in which the second pressure chambers are deformable;

wherein each of the first connection paths extends across the second outlet path row; and wherein the first pressure chambers do not overlap with the common fluid reservoir as viewed in a direction in which the first pressure chambers are deformable.

2. The fluid path unit according to claim 1;

wherein each of the second connection paths is entirely located opposite from the first pressure chamber row with respect to the second outlet path row.

3. The fluid path unit according to claim 2;

wherein the first and second connection paths have a substantially same fluid path resistance.

4. The fluid path unit according to claim 3;

wherein the first and second connection paths have a substantially same fluid path cross-sectional area and a substantially same fluid path length.

5. The fluid path unit according to claim 1;

wherein the first connection paths and the second outlet paths are alternately arranged on the second outlet path row.

6. The fluid path unit according to claim 1;

wherein each of the first connection paths extends obliquely with respect to the second outlet path row.

7. The fluid path unit according claim 1, further comprising:

third pressure chambers arrayed in a third pressure chamber row adjacent to the second pressure chamber row and opposite from the first pressure chamber row;

wherein the third pressure chambers overlap with the common fluid reservoir as viewed in a direction in which the third pressure chambers are deformable.

8. The fluid path unit according to claim 7, further comprising:

third connection paths, through which the third pressure chambers communicate with the common fluid reservoir.

9. The fluid path unit according to claim 1;

wherein each of the first connection paths extends across the first outlet path row.

10. The fluid path unit according to claim 1;

wherein the first outlet path row is located between the first pressure chamber row and the second outlet path row.

11. The fluid path unit according to claim 1;

wherein the first pressure chamber row is located between the first outlet path row and the second outlet path row.

12. The fluid path unit according to claim 1, further comprising:

a dummy chamber, wherein the first pressure chambers overlap with the dummy chamber as viewed in a direction in which the first chamber are deformable.

13. The fluid path unit according to claim 1;

wherein the common fluid reservoir is partly defined by a deformable damper wall.

14. A fluid path unit for a fluid ejection device, comprising:

a pair of a first pressure chamber row and a second pressure chamber row adjacent to each other, each of the first and second pressure chamber rows including plural pressure chambers arrayed in an arraying direction;

a pair of a third pressure chamber row and a fourth pressure chamber row adjacent to each other, each of the third and fourth pressure chamber rows including plural pressure chambers arrayed in the arraying direction;

a pair of a first outlet path row and a second outlet path row, each of the first and second outlet path rows including plural outlet paths arrayed in the arraying direction, wherein the outlet paths of the first and second outlet path rows respectively connect the pressure chambers of the first and second pressure chamber rows to nozzles;

a pair of a third outlet path row and a fourth outlet path row, each of the third and fourth outlet path rows including plural outlet paths arrayed in the arraying direction, wherein the outlet paths of the third and fourth outlet path rows respectively connect the pressure chambers of the third and fourth pressure chamber rows to nozzles;

first connection paths respectively connecting the pressure chambers of the first pressure chamber row to a first common fluid reservoir, each of the first connection paths extending across the second outlet path row;

second connection paths respectively connecting the pressure chambers of the second pressure chamber row to the first common fluid reservoir, wherein the second pressure chambers overlap with the first common fluid reservoir as viewed in a direction in which the second pressure chambers are deformable; and third connection paths respectively connecting the pressure chambers of the third pressure chamber row to the first common fluid reservoir or another second common fluid reservoir, each of the third connection paths extending across the fourth outlet path row;

wherein the pressure chambers of the first pressure chamber row do not overlap with the first common fluid reservoir as viewed in a direction in which the first pressure chambers are deformable, and the pressure chambers of the second pressure chamber row, and at least one of third and fourth pressure chamber rows do overlap with the first common fluid reservoir.

15. The fluid path unit according to claim 14;

wherein the second pressure chamber row is located between the first pressure chamber row and the third pressure chamber row; and wherein the third pressure chamber row is located between the second pressure chamber row and the fourth pressure chamber row.

16. The fluid path unit according to claim 15;

wherein the first common reservoir includes a first common chamber and a second common chamber;

wherein the first connection paths respectively connects the pressure chambers of the first pressure chamber row to the first common chamber;

wherein the third connection paths respectively connects the pressure chambers of the third pressure chamber to the second common chamber;

wherein the pressure chambers of the second and third pressure chamber rows overlap with the first common chamber; and wherein the pressure chambers of the fourth pressure chamber rows overlap with the second common chamber.

17. The fluid path unit according to claim 15;

wherein the first and second outlet path rows are located between the first and second pressure chamber rows; and wherein the third and fourth outlet path rows arc located between the third and fourth pressure chamber rows.

18. The fluid path unit according to claim 15;

wherein the third connection paths respectively connects the pressure chambers of the third pressure chamber row to the second common fluid reservoir;

wherein the first common fluid reservoir contains first ink; and wherein the second common fluid reservoir contains second ink different in color from the first ink.

19. The fluid path unit according to claim 14;

wherein the second pressure chamber row is located between the first pressure chamber row and fourth pressure chamber row; and wherein the fourth pressure chamber row is located between the second pressure chamber row and the third pressure chamber row.

20. The fluid path unit according to claim 19;

wherein the pressure chambers of the first and third pressure chamber rows do not overlap with the first common fluid reservoir, and the pressure chambers of the second and fourth pressure chamber rows do overlap with the first common fluid reservoir.

21. The fluid path unit according to claim 20;

wherein the first pressure chamber row and the second outlet path row are located between the first outlet path row and the second pressure chamber row; and wherein the third pressure chamber row and the fourth outlet path row are located between the third outlet path row and the fourth pressure chamber row.

* * * * *